US006070299A

United States Patent [19]

Schnelle

[11] Patent Number: 6,070,299

[45] Date of Patent: Jun. 6, 2000

[54] FURNITURE HINGE

[75] Inventor: Manfred Schnelle, Kirchlengern, Germany

[73] Assignee: Hettich-ONI GmbH & Co. KG, Vlotho-Exter, Germany

[21] Appl. No.: 09/062,797

[22] Filed: Apr. 20, 1998

[30] Foreign Application Priority Data

Apr. 21, 1997 [DE] Germany ..... 297 07 057

[51] Int. Cl.[7] ..... E05D 5/00

[52] U.S. Cl. ..... 16/382; 16/383

[58] Field of Search ..... 16/382, 383; 411/358, 411/356, 357, 80.5, 80.6

[56] References Cited

U.S. PATENT DOCUMENTS

| | | | |
|---|---|---|---|
| 1,171,336 | 2/1916 | Greene | 411/358 |
| 2,748,594 | 6/1956 | Edwards | 411/358 |
| 4,862,556 | 9/1989 | Grass | 16/382 |
| 5,561,883 | 10/1996 | Lautenschlager | 16/383 |
| 5,586,364 | 12/1996 | Ferrari et al. | 16/383 |
| 5,651,650 | 7/1997 | Herb et al. | 411/358 |
| 5,700,105 | 12/1997 | Salice | 16/382 |

FOREIGN PATENT DOCUMENTS

| | | | |
|---|---|---|---|
| 425927 | 6/1911 | France | 411/358 |
| 27126 | 11/1897 | United Kingdom | 411/358 |

*Primary Examiner*—Chuck Y. Mah
*Attorney, Agent, or Firm*—Henry M. Feiereisen

[57] ABSTRACT

A furniture hinge, includes a hinge part securable to a movable component of a furniture piece, a hinge arm pivotally mounted to the hinge part, a mounting plate connected to the hinge arm, and fastening screws for securing the mounting plate to a body-related component of the furniture piece, with the mounting plate having support studs for projection in a corresponding number of mortises formed in the body-related component of the furniture piece, wherein the fastening screws are arranged in a directly adjoining area of the support studs when threaded in for securing the mounting plate.

11 Claims, 3 Drawing Sheets

FURNITURE HINGE

BACKGROUND OF THE INVENTION

The present invention generally relates to a furniture hinge, and more particularly is directed to a furniture hinge of a type including a hinge part securable to a movable component of a furniture piece, a hinge arm pivotally mounted to the hinge part, a mounting plate connected to the hinge arm, and fastening screws for securing the mounting plate to a body-related component of the furniture piece, with the mounting plate having support studs for projection in a corresponding number of mortises formed in the body-related component of the furniture piece.

Furniture hinges are known in a wide variety of designs. Typically, the hinge part is secured to a swingable door, gate or the like while the mounting plate is fastened to a wall of the body-related part of the furniture piece. Normally, the support studs are formed as expansion sleeves which are made expandable by the fastening screws. While the mounting plate is typically made of metal, the expansion sleeve is fabricated from plastic material and connected to the metal component. Thus, damage or even rupture of the expansion sleeve is unavoidable. In such cases, the use of additional screws is required in order to secure the mounting plate to the furniture body.

There are also known furniture hinges in which the mounting plate is secured by a fastening screw positioned in a central area between the support studs.

SUMMARY OF THE INVENTION

It is thus an object of the present invention to provide an improved furniture hinge, obviating the afore-stated drawbacks.

In particular, it is an object of the present invention to provide an improved furniture hinge which allows between the mounting plate and the furniture body a permanent connection which can be subjected to extremely high loads.

These objects, and others which will become apparent hereinafter, are attained in accordance with the present invention by arranging the fastening screws in immediate proximity of the support studs.

In accordance with the present invention, the mounting plate is secured by the support studs projecting into the mortises and the fastening screws which are threaded into the mortises normally at application of forces. As the fastening screws are positioned in the directly adjacent area of the support studs and thus are not threaded into the studs, the risk of destruction or damage of the studs is substantially eliminated, thereby effecting an extremely permanent and highly stressable connection. This connection can be subjected to even higher loads when the stud-proximate flanks of the fastening screws cut into the outer area of the studs during engagement in the mortises.

Suitably, the fastening screws are so-called self-tapping screws so that threads are cut into the adjacent support studs when threading the fastening screws into the furniture body, thereby effecting an additional connection between the fastening screw and the support stud. Advantageously, the support studs are of massive configuration to positively eliminate any deformation.

According to another feature of the present invention, the fastening screws are arranged on opposing sides of the support studs to effect a symmetric disposition, with the imaginary connecting lines between the support studs forming the axis of symmetry. This symmetric disposition is also extremely effective to absorb forces.

Oftentimes, furniture hinges are attached to the furniture pieces, e.g. to the partition of a closet, on both sides thereof, with the mounting plates being positioned symmetrically to one another. When using conventional furniture hinges, the shaft of each fastening screw must be designed at such a length that an impact of both screws that are threaded in from opposite sides is prevented, i.e. the length of the shaft of the screw should not exceed half the thickness of the plate-shaped body-related furniture piece. This constraint with regard to the length of the shafts of fastening screws is now eliminated by a furniture hinge according to the present invention, because the fastening screws of the two mounting plates attached in opposition to the body-related furniture piece are arranged in offset disposition, so that the fastening screws may now have a length which exceeds half the thickness of the body-related furniture piece as the end regions of the fastening screws overlap one another. In order to prevent the end region of the fastening screw which is threaded in from the opposite side of the furniture, from damaging the other support stud, it is suitable to provide the free end zone of the support studs at the side distant to the fastening screw with a free space through formation of a bevel for allowing passage of the fastening screw. This configuration also prevents application of an excessive torque when tightening the fastening screw from the opposite side.

According to another feature of the present invention, the support stud is formed on the screw-proximate side with a slanted ramp to facilitate cutting of the thread into the support stud. In this case, the center longitudinal axis extends in the wall of the mortise. However, the center longitudinal axis may also extend at a slight offset to provide a same effect. The slanted ramp may also be arched in order to conform to the shaft of the fastening screw.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
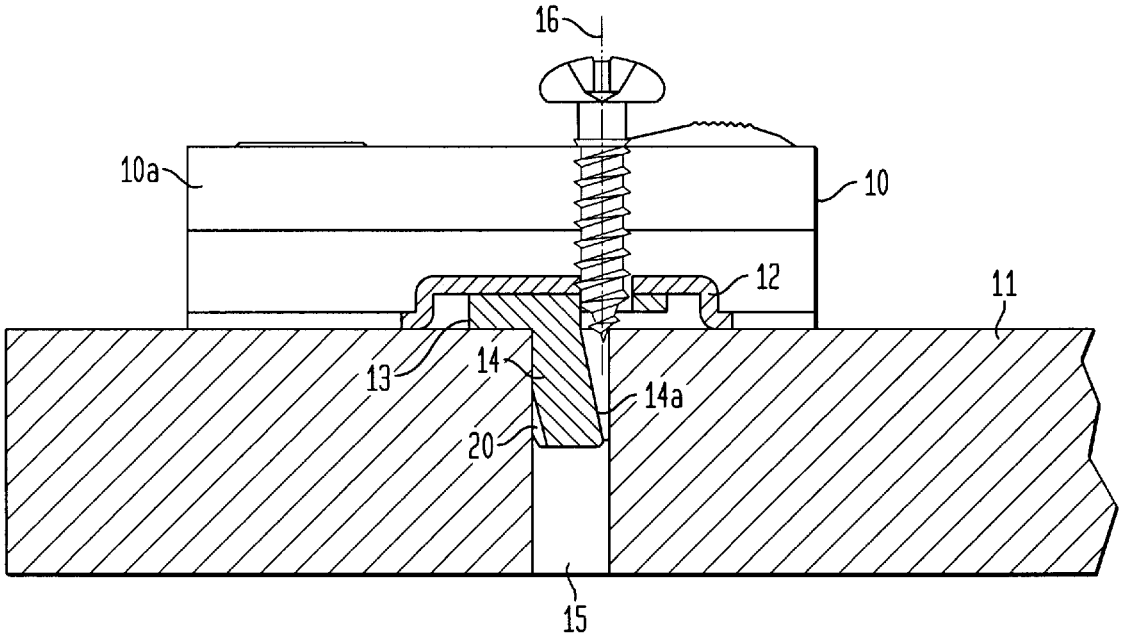
FIG. 1 is a partially sectional view of a mounting plate according to the present invention as part of a furniture hinge, showing a fastening screw in a position prior to threaded engagement.

Throughout all the Figures, same or corresponding elements are generally indicated by same reference numerals.

Turning now to the drawing, and in particular to FIG. 1, there is shown a partially sectional view of a mounting plate, according to the present invention, generally designated by reference numeral 10 as part of a furniture hinge. Persons skilled in the art will understand that the furniture hinge must contain more components that are not shown in the foregoing drawings. For example, the furniture hinge includes a hinge arm which is articulated directly or indirectly to the mounting plate 10 and connectable to the body-related component of the furniture piece. The hinge arm, like much other necessary components, is not part of the invention and has been omitted from the Figures for the sake of simplicity.

The mounting plate 10 is designed for attachment to a body-related component 11, e.g. a side wall, of a piece of furniture, and includes a carrier 10*a* formed with two fastening flanges 12 lying with their angled ends on the inside of the body-related component 11 of the furniture piece. The mounting plate 10 is made of metal and further includes an anchoring member in the form of a plastic piece 13 which is formed with two spaced-apart support studs 14 (only one stud can be seen in the illustration of FIG. 1) for engagement in mortises 15 of the body-related component 11 of the furniture piece. The mortises 15 may be bores or blind bores.

Securement of the mounting plate 10 to the body-related component 11 of the furniture piece is effected by two fastening screws 16 which are received in respective bores of the mounting plate 10. As the fastening screws 16 are of an identical construction and operate in a same manner in conjunction with the support studs, the following description with respect to FIGS. 1 and 2 refers to only one fastening screw 16 in detail.

Figure 2:
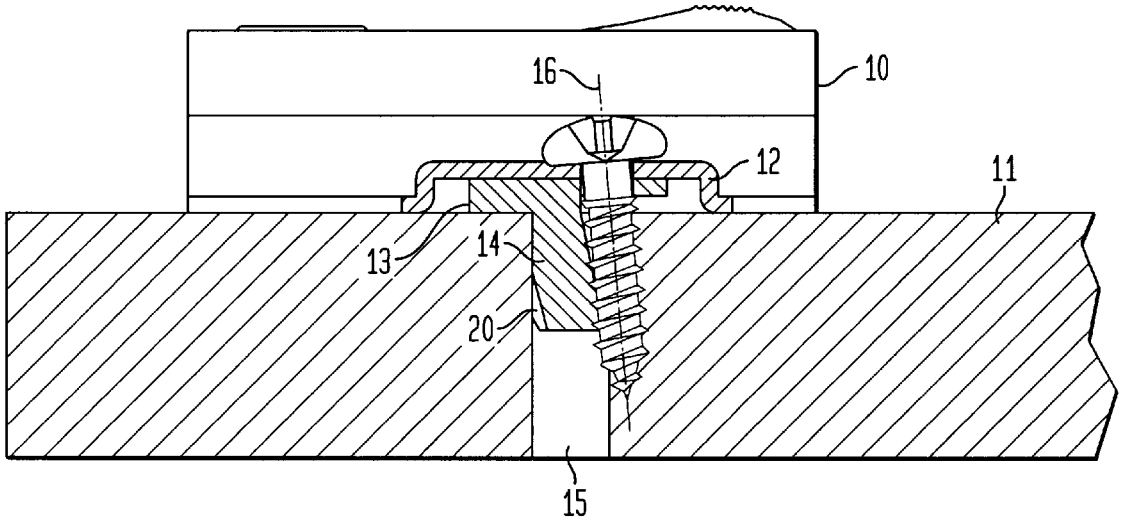
FIG. 2 is a partially sectional view of the mounting plate, showing the fastening screw in installed state.

As shown in FIG. 1, in the pre-securement state, the fastening screw 16 is so positioned that its center axis is in alignment with the wall of the mortise 15. After being tightened and thus fully threaded in, the fastening screw 16 lies with its shaft in immediate proximity to the support stud 14, with the center axis of the fastening screw 16 extending at an acute angle to the mortise 15, as shown in FIG. 2. In order to effect the deflection of the fastening screw 16 in this manner, the support stud 14 is formed at the fastening screw proximate side with a slanted ramp 14*a* which is so shaped that the end area of each support stud 14 maintains its round base form. When the fastening screw 16 is screwed in, the slanted ramp 14*a* of the support stud 14 enables the thread of the fastening screw 16 to cut into the slanted ramp 14*a* and a deflection of the fastening screw 16 sideways into a position shown in FIG. 2, with its center axis extending at an acute angle to the mortise 15 and support stud 14. Through effecting an inclined disposition of the fastening screw 16, the attained connection that can be subjected to extremely high loads. Suitably, the shaft of the fastening screw 16 has a length which is greater than half the thickness of the plateshaped body-related component 11 of the furniture piece to further enhance the solid connection.

Figure 3:
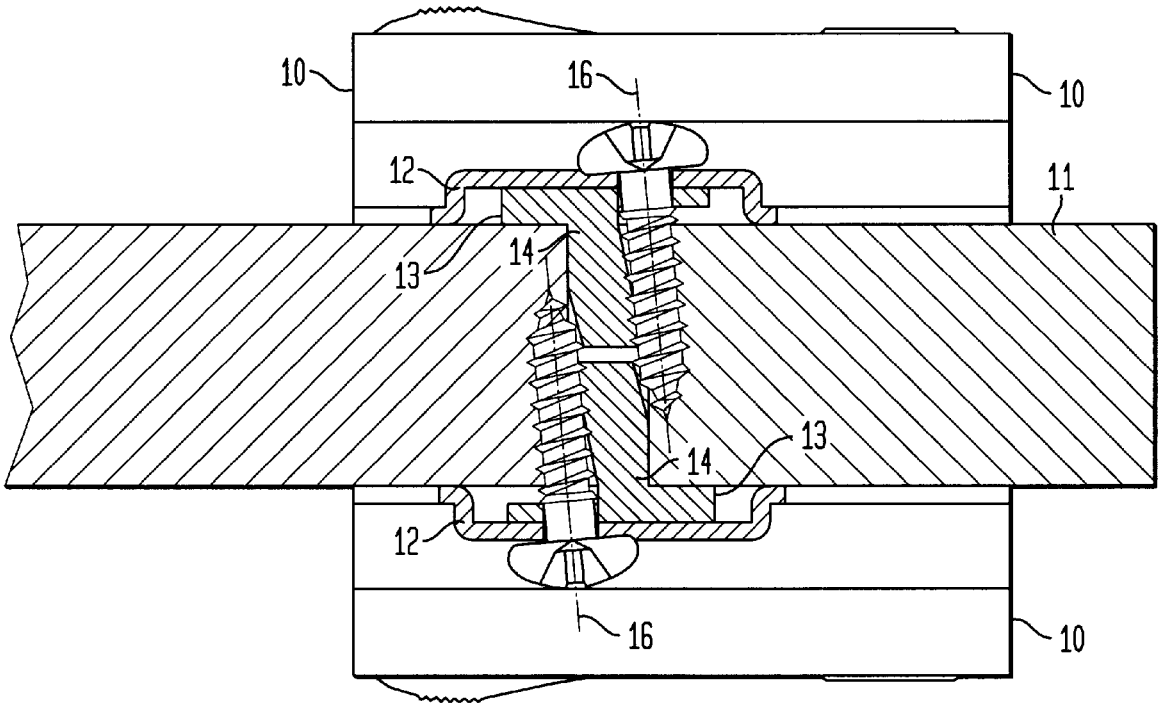
FIG. 3 is a partially sectional view of two such mounting plates attached to both sides of a body-related component of a furniture piece.

Turning now to FIG. 3, there is shown a partially sectional view of two such mounting plates 10 which are attached to both sides of a body-related component 11 of a furniture piece, e.g. a partition wall of a closet, with the mounting plates 10 positioned in symmetric relationship with respect to the center plane. Thus, as shown in FIG. 3, as the fastening screws 16 can exceed half the thickness of the body-related component 11 of the furniture piece, the end regions of the shafts of the fastening screws 16 that are forced in from opposite sides overlap one another as the fastening screws 16 are deflected sideways away from one another and thus are arranged in offset disposition when interacting with the respective support studs 14 which extend in alignment in the mortise 15. In order to provide a free space for the end region of the shaft of each fastening screw 16, the support studs 14 are provided at the shaft distant side thereof with a bevel 20 (see FIGS. 1 and 2).

Figure 4:
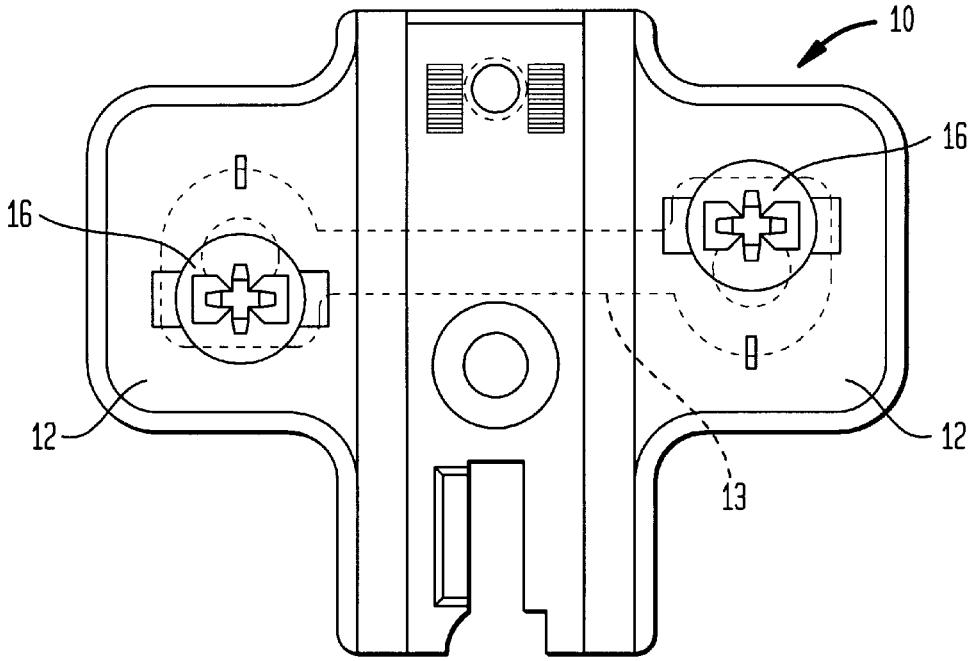
FIG. 4 is a plan view of the mounting plate of FIG. 1.
Figure 5:
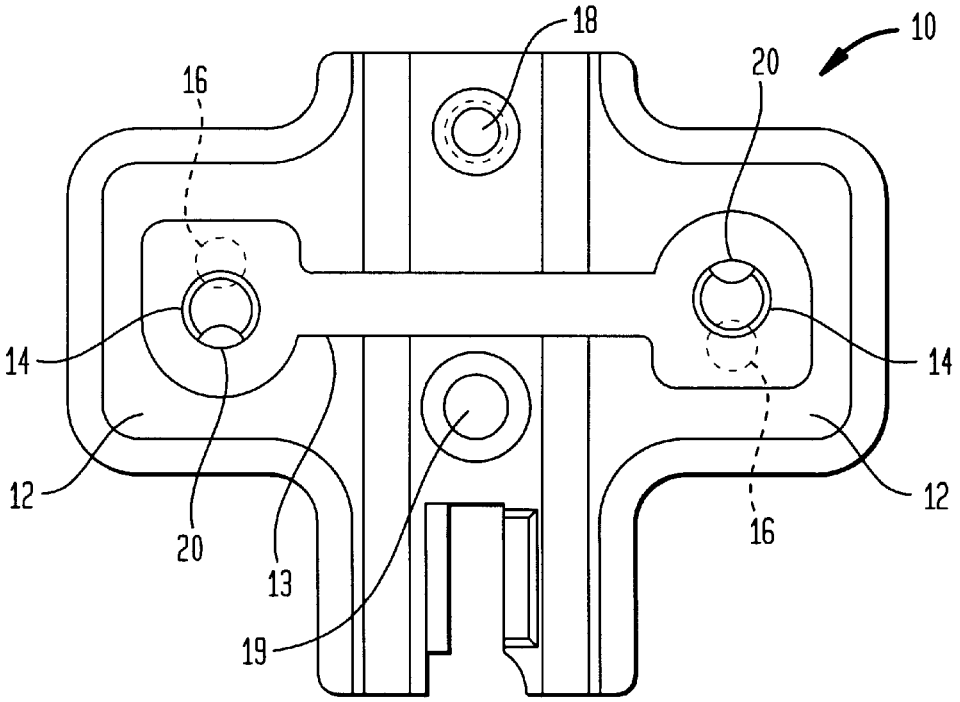
FIG. 5 is a bottom view of the mounting plate of FIG. 4.

Referring now to FIGS. 4 and 5, there are shown top and bottom plan views of the mounting plate 10. At its underside, i.e. the side facing the body-related component 11 of the furniture piece, the mounting plate 10 is provided with the plastic piece 13 which is formed with the spaced-apart support studs 14 for engagement in the mortises 15 at application of a certain force. As shown in FIGS. 4 and 5, the two fastening screws 16 are arranged at opposite sides of the support studs 14 and thus are arranged offset to one another with respect to an imaginary connection line between the support studs 14.

In the area between the fastening flanges 12, the mounting plate 10 is of U-shaped configuration and is formed in this area with a threaded bore 18 and a countersunk bore 19 for engagement by further adjusting screws (not shown) in order to secure e.g. the hinge arm or a quick-mounting plate (not shown). Moreover, these components may be suitably aligned with respect to the mounting plate 10 through respective adjustment of a fastening screw.

In particular FIG. 5 shows the offset of the fastening screws 16 relative to the center axis of the support studs 14 so that the thread of the fastening screws 16 is able to cut into the support stud 14. FIG. 5 also shows the slanted surfaces 20 at the screw-distant side of the support studs 14.

Persons skilled in the art will understand that the mounting plate 10 according to the present invention is described herein with respect to a furniture piece by way of example only and should not be limited thereto. While especially suitable for use in home furniture, a mounting plate according to the invention and formed with support studs which so interact with fastening screws as to effect an offset disposition of the fastening screws may be used in a wide variety of other applications to create an attachment that can be subject to a high loads and is permanent.

While the invention has been illustrated and described as embodied in a furniture hinge, it is not intended to be limited to the details shown since various modifications and structural changes may be made without departing in any way from the spirit of the present invention.

What is claimed as new and desired to be protected by Letters Patent is set forth in the appended claims:

1. A furniture hinge, comprising a hinge part securable to a movable component of a furniture piece; a hinge arm pivotally mounted to the hinge part; a mounting plate designed for connection to the hinge arm; and fastening means for securing the mounting plate to a body-related component of the furniture piece, said mounting plate having at least one support stud for engagement in a mortise formed in the body-related component of the furniture piece, said fastening means includes a fastening screw being so received in the mortise that flanks of the fastening screw facing the support stud cuts into an outer area of the support stud when the fastening screw is threaded into the mortise.

2. The furniture hinge of claim 1 wherein the support stud is developed as a solid stud.

3. The furniture hinge of claim 1 wherein the mounting plate is formed with at least two such support studs for engagement in a corresponding number of such mortises in the body-related component of the furniture piece, said fastening means including at least two such fastening screws arranged on opposing sides of the support studs.

4. The furniture hinge of claim 1 wherein the fastening means includes a fastening screw having a shaft of a length which is greater than half a thickness of the body-related component of a furniture substrate.

5. The furniture hinge of claim 1 wherein the support stud has a free end region formed with a bevel at a surface of the support stud which is away from the fastening means.

6. The furniture hinge of claim 1 wherein the support stud is formed with a slanted ramp at a surface of the support stud proximate to the fastening means.

7. A mounting element adapted for use in combination with a furniture hinge for attachment to a piece of furniture, said mounting element including a carrier for placement on the piece of furniture, an anchoring member provided interiorly of the carrier and including at least one support stud for engagement in a mortise formed in the piece of furniture, and at least one fastening screw received in aligned bores of the carrier and the anchoring member; the support stud has a slanted ramp so when securing the mounting element to the furniture piece, the fastening screw is deflected sideways into the piece of furniture by the support stud when being threaded into the mortise.

8. The mounting element of claim 7 wherein the fastening screw is defined by an axis and the support stud is defined by an axis, said axis of the fastening screw extending at an acute angle with respect to the axis of the support stud when threaded into the mortise.

9. The mounting element of claim 7 wherein the anchoring member is formed with two spaced-apart such support studs for engagement in two such mortises and interaction with two such fastening screws, said anchoring member defining an axis, said fastening screws being positioned on opposite sides of the support studs.

10. The mounting element of claim 7 wherein the fastening screw has a shaft of a length which is greater than half a thickness of the piece of furniture.

11. The mounting element of claim 7 further comprising another like mounting element for attachment in opposite disposition to the piece of furniture, wherein fastening screws of the mounting elements threaded in from opposite sides of the furniture overlap one another.

* * * * *